US007278246B2

(12) United States Patent
Nahmias

(10) Patent No.: US 7,278,246 B2
(45) Date of Patent: Oct. 9, 2007

(54) NESTING CLOSURE STRIP

(75) Inventor: Shmuel Nahmias, Galil Elion (IL)

(73) Assignee: Plasgad Plastic Products Agricultural Cooperative Ltd., Kibbutz Gadot (IL)

( * ) Notice: Subject to any disclaimer, the term of this patent is extended or adjusted under 35 U.S.C. 154(b) by 0 days.

(21) Appl. No.: 11/101,505

(22) Filed: Apr. 8, 2005

(65) Prior Publication Data

US 2006/0236646 A1 Oct. 26, 2006

(51) Int. Cl.
*E04B 1/38* (2006.01)
*E04C 2/32* (2006.01)

(52) U.S. Cl. ..... 52/712; 52/699; 52/700; 52/537; 52/DIG. 15; 52/783.11; 52/798.1; 206/499; 206/321

(58) Field of Classification Search ..... 52/478, 52/92.1, 95, 198, 407.3, 483.1, 537, 553, 52/311, DIG. 15, 220.4, 783.11, 798.1, 336, 52/698–700, 712–715; D8/354; 428/182, 428/192, 156; 108/53.3; 206/499, 321
See application file for complete search history.

(56) References Cited

U.S. PATENT DOCUMENTS 2,105,280 A * 1/1938 Bass ..... 52/720.1
2,361,112 A * 10/1944 Llewellyn ..... 52/478
3,385,018 A * 5/1968 Harry ..... 52/403.1
4,017,090 A * 4/1977 Cohen ..... 277/644
4,068,423 A * 1/1978 Marsh ..... 52/86
4,401,705 A * 8/1983 Ewert ..... 428/131
5,390,453 A * 2/1995 Untiedt ..... 52/90.1
D465,992 S * 11/2002 Sarig ..... D8/354

FOREIGN PATENT DOCUMENTS

CA 1123568 A * 5/1982

* cited by examiner

*Primary Examiner*—Jeanette Chapman
(74) *Attorney, Agent, or Firm*—Mark M. Friedman

(57) ABSTRACT

The closure strip having a pair of longitudinal side walls with undulating top edges configured to mate with the corrugations of corrugated sheet material. The side walls are interconnected by a plurality of support ribs. The side walls are also angled outward toward the bottom edges. A hollow nesting volume is formed between the side and below the support ribs in the region of each of the undulation peaks of the closure strip. This configuration allows successive closure strips to be nested one into another by inserting the undulation peaks of one closure strip into the hollow nesting volume under corresponding undulation peaks in another closure strip.

6 Claims, 4 Drawing Sheets

NESTING CLOSURE STRIP

FIELD AND BACKGROUND OF THE INVENTION

The present invention relates to closure strips and, in particular, it concerns closure strips that may be nested for shipping and storage.

Corrugated sheeting, such as fiberglass, sheet metal and aluminum, is widely used in the construction trade for forming roofs, fences, patio enclosures and the like. The corrugated design gives the sheets strength. However, there has been a continuing and largely unsatisfactorily solved problem relating to the shipping and storage of the closure strips that are used to fasten the corrugated sheeting to supporting objects such as joists, trusses, posts and the like.

Originally, closure strips were made from wooden molding strips having a rectangular cross section. These wooden molding strips are longitudinally bisected by a wave cut having a corrugation corresponding to the corrugations of the sheeting. For shipping and storage purposes, the two cut pieces of wood are left together and pairs of closure strips are stacked and banded together very much like the way traditional rectangular molding strips are handled.

Recent advancements in the plastic molding industry have provided practical alternatives to the wood strip moldings. However, the design of these closure strips is based on the traditional wooden closure strips. Specifically, the molded plastic closure strips have a flat bottom surface and corrugated top surface and substantially vertically parallel side walls. Therefore, the molded plastic closure strips of prior art suffer from the same shipping and storage problem as the wooded closure strips. That is, two strips may be paired and a stack of paired strips may be banded together.

This method of stacking closure strips for shipping and storage is space inefficient and costly.

There is therefore a need for a closure strip that may be nested one within another for shipping and storage purposes.

SUMMARY OF THE INVENTION

The present invention is a closure strip that may be nested one within another for shipping and storage purposes.

According to the teachings of the present invention there is provided, a closure strip for supporting corrugated sheet material, the closure strip comprising: a) a pair of longitudinal side walls having undulating top edges configured to mate with the corrugations of the corrugated sheet material, and having substantially longitudinally parallel bottom edges, the side walls being vertically non-parallel so as to angle outwardly toward the bottom edges; and b) a plurality of support ribs configured to interconnect the pair of side walls; wherein at least one hollow nesting volume is formed between the side walls and below the support ribs so as to allow the nesting of at least a portion of a similar closure strip within the hollow nesting volume.

According to a further teaching of the present invention, at least a first support rib configuration of the plurality of support ribs is configured in each undulation trough, and a bottom edge of the first support rib configuration and the bottom edges of the side walls are co-planar.

According to a further teaching of the present invention, the at least one hollow nesting volume is configured as a plurality of hollow nesting volumes, one such hollow nesting volume being formed between each undulation trough.

According to a further teaching of the present invention, each of the first support rib configuration is configured to allow passage of an attachment element.

According to a further teaching of the present invention, there is also provided two end walls.

According to a further teaching of the present invention, the end walls are configured so as to provide for interconnection of two similar closure strips end to end.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a closure strip that may be nested one within another for shipping and storage purposes.

The principles and operation of closure strip according to the present invention may be better understood with reference to the drawings and the accompanying description.

By way of introduction, the closure strip of the present invention is intended to fasten corrugated sheeting to supporting objects such as joists, trusses, posts and the like. The closure strip has a pair of longitudinal side walls with undulating top edges configured to mate with the corrugations of the corrugated sheet material. It should be noted that the undulating pattern may be configured as a smooth wavelike form, an angular trapezoidal form, or to mate with substantially any corrugation pattern configured in the corrugated sheet material. The side walls are interconnected by a plurality of support ribs. The side walls are also angled outward toward the bottom edges. A hollow nesting volume is formed between the side and below the support ribs in the region of each of the undulation peaks of the closure strip. This configuration allows successive closure strips to be nested one into another by inserting the undulation peaks of one closure strip into the hollow nesting volume under corresponding undulation peaks in another closure strip. Nesting the closure strips in this manner reduces the storage space required by a number of closure strips of the present invention compared to an equal number of closure strips of the prior art, thereby providing a more efficient use of shipping and storage space. Further, the stability of the stack is superior to those of the prior art, since all of the closure strips in the stack are nestedly interconnected.

Figure 1:
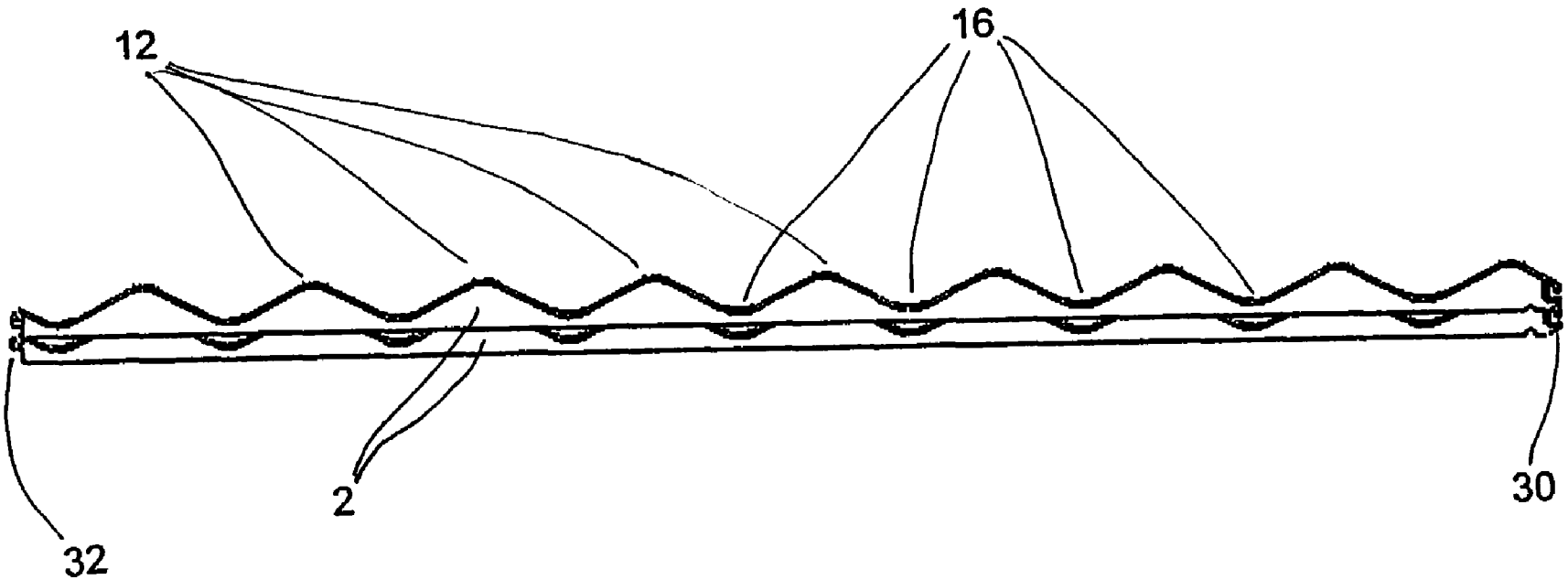
FIG. 1 is a side elevation of two nesting closure strips constructed and operative according to the teachings of the present invention.
Figure 2:
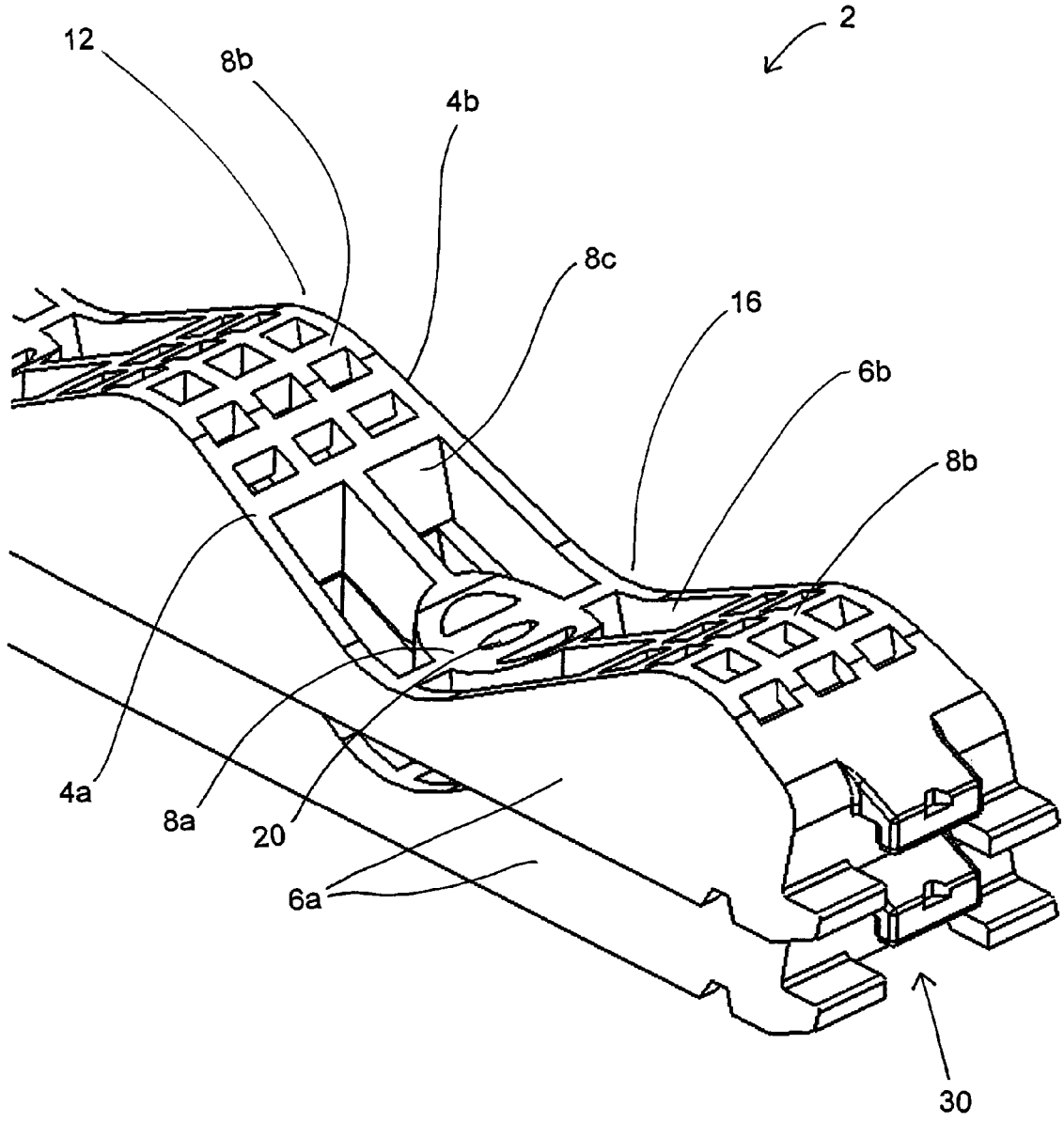
FIG. 2 is an isometric detail of an end portion of the embodiment of FIG. 1.

Referring now to the drawings, FIG. 1 illustrates two closure strips, generally referred to herein as 2, deployed in a nested state. As seen in the detail of FIG. 2, in the preferred embodiment illustrated herein, the two longitudinal side walls 6*a* and 6*b* have undulating top surfaces 4*a* and 4*b* that are configured to mate with the corrugation pattern of the corrugated sheeting it will support when installed. The side walls 6*a* and 6*b* are interconnected by a plurality of support ribs 8*a*, 8*b* and 8*c* that extend between the two side walls 6*a* and 6*b*. It should be noted, however, that a substantially solid top surface bridging the top edges of the two side walls is within the scope of the present invention. The configuration illustrated herein reduces the amount of material required to fabricate the closure strip thereby reducing production costs and weight of the finished closure strip.

Figure 4:
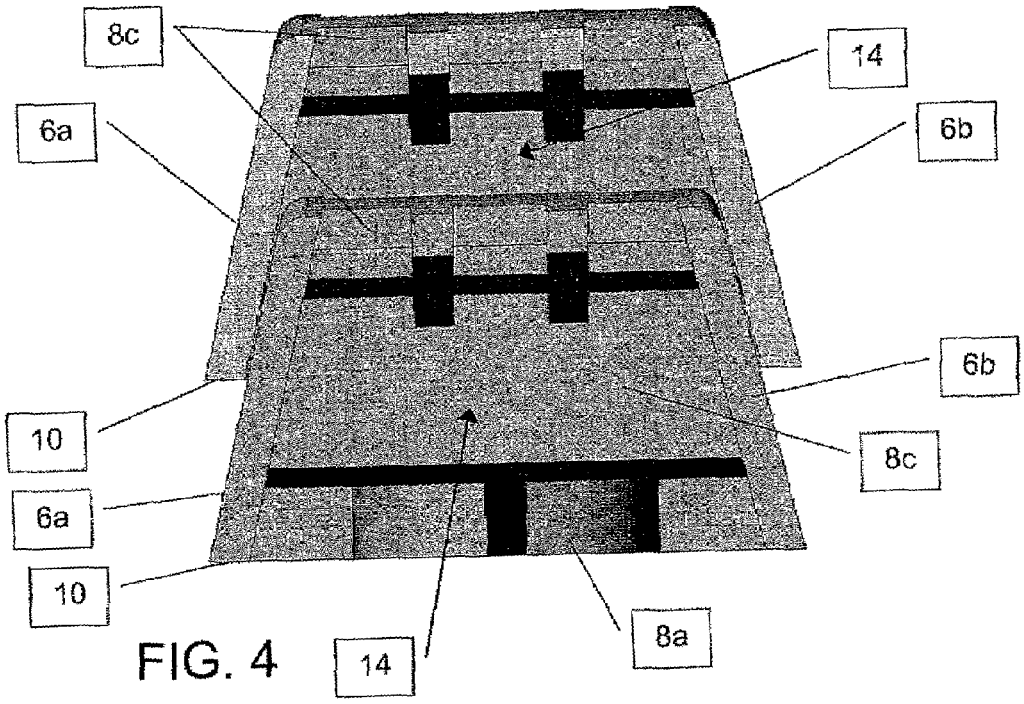
FIG. 4 is a cross-sectional end view of FIG. 3.

As illustrated in FIG. 4, the side walls 6*a* and 6*b* extend downward from the top edges 4*a* and 4*b* at an outward angle ending at longitudinally parallel bottom edges 10. That is to say, the side walls 6*a* and 6*b* are vertically non-parallel such that the distance between the side walls 6*a* and 6*b* increases as a function of the distance from the top edges 4*a* and 4*b*.

In use, the closure strips 2 are fastened in place by a fastening element such as, but not limited to, nails, screws, or bolts that pass through the corrugated sheet material, through the closure strip and into the support surface. To facilitate such fastening, a hole 20 is provided in support rib configuration 8*a*, which is configured in each of the trough regions 16 in the undulation pattern of the top edges 4*a* and 4*b* of the closure strip 2. To maintain the structural integrity of support rib 8*a*, it has a bottom edge that is co-planar with the bottom edges 10 of the side walls 6*a* and 6*b*.

Figure 3:
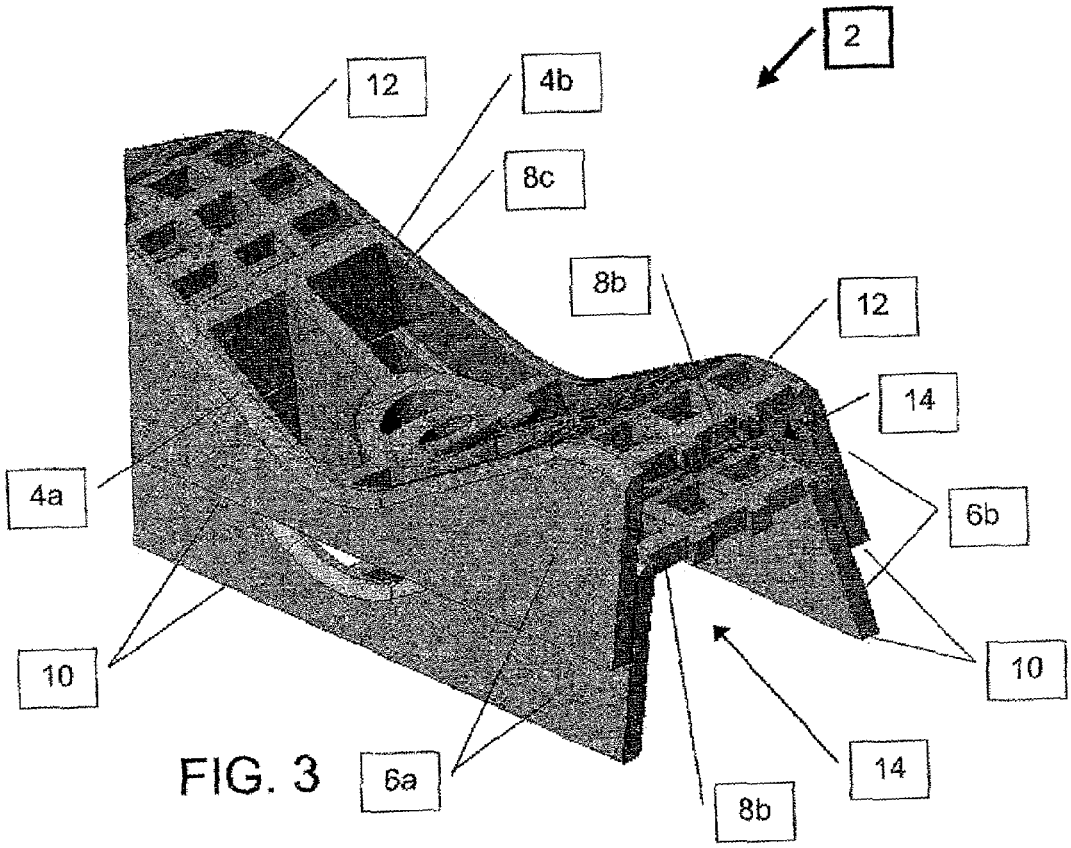
FIG. 3 is an isometric cross-sectional view the embodiment of FIG. 1, showing two nested closure strips.
Figure 5:
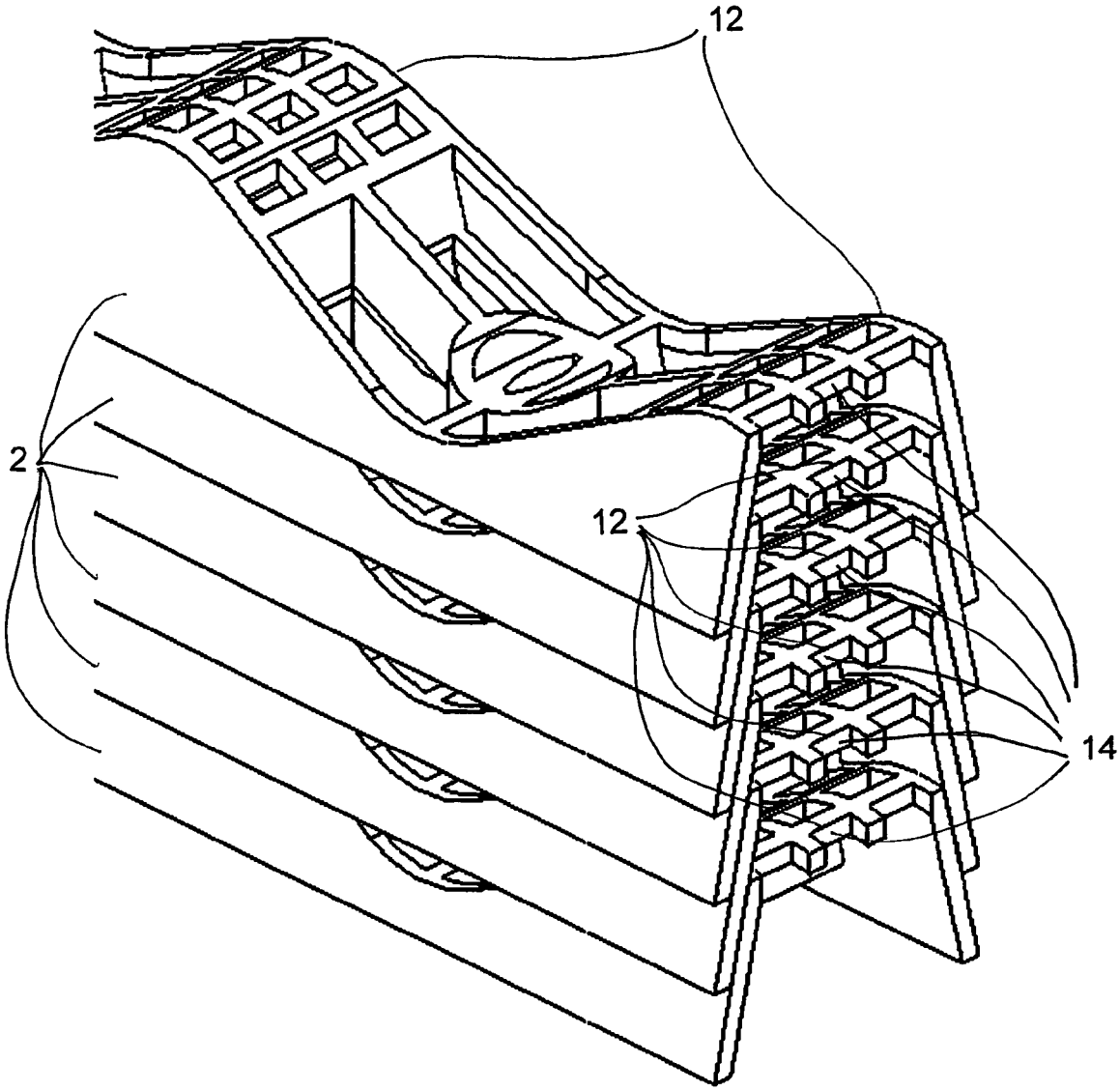
FIG. 5 is an isometric cross-sectional view the embodiment of FIG. 1, showing six nested closure strips.

The top portion of each of the undulation peaks 12 is configured with support ribs 8*b* and 8*c* that extend only a portion of the height of the side walls 6*a* and 6*b*, thereby providing a hollow nesting volume 14 between each of the troughs in the regions corresponding to each of the undulation peaks 12. This hollow nesting volume 14 allows for corresponding undulation peaks 12 of one closure strip to be nested between the side walls 6*a* and 6*b* of another like closure strip 2, as illustrated in FIG. 1. As best seen in FIGS. 3-5, support ribs 8*c*, which are configured on each side of the undulation peaks 12, preferably extend from the top edges 4*a* and 4*b* about 60 percent of the height of the side walls 6*a* and 6*b* in order to give support and rigidity to the side walls. It should be noted that the thickness of the walls and support ribs directly effects the amount of nesting provided. Preferably, about 50 percent of the overall height of the closure strip may be nested within another, however, nesting that is within the range of 25-75 percent is within the scope of the present invention. Support ribs 8*c*, which are configured on the undulation peaks 12 are substantially the same thickness as the side walls 6*a* and 6*b*. This configuration provides the necessary support and rigidity for the side walls while conserving materials and lowering the overall weight of the closure strips of the present invention. As noted above, the height of the support ribs 8 may vary in order to provide the necessary support and rigidity to the side walls while providing the necessary hollow nesting volume in the underside of the closure strip required for nesting.

It should be noted that although the embodiment of the present invention illustrated herein has side walls 6*a* and 6*b* having a smooth outwardly angled configuration, substantially any configuration that provides space below the top surface and between the side walls of a closure strip such that one closure strip may be nested within that space is within the scope of the present invention.

FIG. 5 illustrates the utility of the nested arrangement of the closure strips of the present invention. The number of closure strips nested in a stack is limited only by the desired height of the stack for shipping or storage purposes.

As illustrated in FIGS. 1 and 2, the closure strips of the present invention include end walls 30 and 32 that are configured with an interlocking configuration that allows each of the closure strips to be interconnected to another like closure strip in an end-to-end arrangement when the closure strips are deployed for end use.

It will be appreciated that the above descriptions are intended only to serve as examples, and that many other embodiments are possible within the spirit and the scope of the present invention.

What is claimed is:

1. A closure strip for supporting corrugated sheet material, the closure strip comprising:

a) a pair of longitudinal side walls having undulating top edges configured to mate with the corrugations of the corrugated sheet material, and having substantially longitudinally parallel bottom edges, said side walls being vertically non-parallel so as to angle outwardly toward said bottom edges; and b) a plurality of support ribs configured at least in a region of each undulation peak of said undulating top edges so as to interconnect said pair of side walls;

wherein at least one hollow nesting volume is formed between said side walls and substantially directly below said support ribs in said region of each said undulation peak so as to allow the nesting of at least a portion of an undulation peak of a similar closure strip within said hollow nesting volume.

2. The closure strip of claim 1, wherein said plurality of support ribs is further configured in each undulation trough of said undulating top edges, and a bottom edge of said first support ribs in each said undulation trough and said bottom edges of said side walls are co-planar.

3. The closure strip of claim 2, wherein said at least one hollow nesting volume is configured as a plurality of hollow nesting volumes, one such hollow nesting volume being formed between each undulation trough.

4. The closure strip of claim 2, wherein each of said support ribs in said undulation trough is configured to allow passage of an attachment element.

5. The closure strip of claim 1, further including two end walls.

6. The closure strip of claim 5, wherein said end walls are configured so as to provide for interconnection of two similar closure strips end to end.

* * * * *